US008603926B2

(12) United States Patent
Grynaeus et al.

(10) Patent No.: US 8,603,926 B2
(45) Date of Patent: Dec. 10, 2013

(54) TEXTILE FABRIC WITH IMPROVED FINISH, PRODUCTION AND USE THEREOF

(75) Inventors: Peter Grynaeus, Birkenau (DE); Gerhard Schaut, Hemsbach (DE); Steffen Kremser, Heddesheim (DE); Michael Kalbe, Weinheim (DE); Oliver Staudenmayer, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 976 days.

(21) Appl. No.: 11/816,133

(22) PCT Filed: Feb. 10, 2006

(86) PCT No.: PCT/EP2006/001192
§ 371 (c)(1),
(2), (4) Date: Apr. 11, 2008

(87) PCT Pub. No.: WO2006/084700
PCT Pub. Date: Aug. 17, 2006

(65) Prior Publication Data

US 2008/0311809 A1 Dec. 18, 2008

(30) Foreign Application Priority Data

Feb. 12, 2005 (DE) ..... 10 2005 006 470

(51) Int. Cl.
*B32B 7/14* (2006.01)
*B29C 65/02* (2006.01)

(52) U.S. Cl.
USPC ..... 442/64; 442/71; 156/290; 156/291

(58) Field of Classification Search
USPC ..... 442/71, 64, 66; 156/290, 291
See application file for complete search history.

(56) References Cited

U.S. PATENT DOCUMENTS

| | | | | |
|---|---|---|---|---|
| 3,893,883 | A | 7/1975 | Higuchi | |
| 4,310,373 | A * | 1/1982 | Schuhmacher et al. | 156/308.2 |
| 6,300,413 | B1 * | 10/2001 | Simon et al. | 525/131 |
| 6,344,238 | B1 | 2/2002 | Schmitt et al. | |
| 6,777,065 | B2 | 8/2004 | Grynaeus et al. | |
| 2002/0019185 | A1 * | 2/2002 | Grynaeus et al. | 442/149 |

FOREIGN PATENT DOCUMENTS

| | | |
|---|---|---|
| CH | 679257 | 1/1992 |
| DE | 142236 | 7/1903 |
| DE | 2351405 | 4/1975 |
| EP | 0097496 | 1/1984 |
| EP | 110454 | 6/1984 |
| EP | 0 731 151 | 9/1996 |
| GB | 1435067 | 5/1976 |
| GB | 1474455 | 5/1977 |
| IE | 39941 | 1/1979 |
| JP | 50-66579 | 6/1975 |
| JP | 9-59810 | 3/1997 |
| JP | 2000-345475 | 12/2000 |
| JP | 2001-279510 | 10/2001 |
| JP | 2002-20919 | 1/2002 |
| JP | 2003-82300 | 3/2003 |
| JP | 2004-92010 | 3/2004 |
| WO | 2004073436 | 9/2004 |

OTHER PUBLICATIONS

International Search Report dated Jun. 22, 2006 issued in related International Patent Application No. PCT/EP2006/001192.
"Pearlbond 125/h" Internet Article, Oct. 2003. retrieved from http://www.merquinsa.com/p_info/pearlbond/125H.pdf.
VESTAMELT® 840 Product Information, Evonik Industries, Germany, Feb. 2012.
VESTAMELT® 730 Product Information, Evonik Industries, Germany, Feb. 2012.
Griltex® D 1541A Copolyamide Hotmelt Adhesive (Apparel Interlinings), www.matweb.com.

* cited by examiner

*Primary Examiner* — Matthew Matzek
(74) *Attorney, Agent, or Firm* — Grossman, Tucker, Perreault & Pfleger, PLLC

(57) ABSTRACT

The invention relates to a textile fabric having a coating composed of two layers of thermoplastic hot-seal adhesives of differing compositions applied one on top of the other, the second hot-seal adhesive, which is applied to the first, having a melting point of >135° C. and a melt flow index (MFI) value of 50 to 250 g/10 minutes (190° C./2.16 kg). The invention further relates to a method for producing a textile fabric, comprising the following steps: a) producing a textile fabric using a textile fabric manufacturing technique; b) applying a layer of a first hot-seal adhesive to the textile fabric; and c) applying a layer of a second hot-seal adhesive to the textile fabric so as to d) form a layer of the second hot-seal adhesive over the layer of first hot-seal adhesive, the second hot-seal adhesive used having a melting point of >135° C. and a melt flow index (MFI) value of 50 to 250 g/10 minutes (190° C./2.16 kg). The textile fabrics may be used as interlining or lining material which can withstand stress during care treatment.

13 Claims, No Drawings

TEXTILE FABRIC WITH IMPROVED FINISH, PRODUCTION AND USE THEREOF

The present invention relates to textile fabrics which are suited in particular as interlining or lining materials and characterized by improved application properties and improved processibility, and production and use thereof as interlining for textiles.

It is known that various thermoplastic materials may be used as adhesive media for heat bonding of interlining or lining materials. Copolyamides, copolyesters, and polyolefins are commonly used.

Several approaches are known from the prior art for improving the processing and application properties of interlining materials.

U.S. Pat. No. 3,893,883 describes sheet materials coated with hot-melt adhesive, a mixture of a selected polyethylene and a terpene resin being used as hot-melt adhesive.

EP-A 110 454 describes interlining having improved bond strength and dry cleaning resistance, characterized by use of selected polyethylenes having a very narrow molecular weight distribution, high density, and selected melt flow index (MFI).

To improve the changes in handling parameters and coefficients of adhesion within a broad processing range, and for providing uniform fusion conditions for a large number of outer shell materials, textile fabrics have been developed which have gridded layers composed of hot-seal adhesives of differing adhesive compositions. Such fabrics are described in DE-A-22 142 236 and DE-A-23 51 405. Contact adhesives composed of various polymers have been used in previously known fabrics. This known "double dot process" has been used for years in the manufacture and processing of interlining and lining materials.

As a result of their differing molecular structures, the polymers differ in their physical and chemical properties, such as melting point, viscosity, and stability against solvents such as wash water and dry cleaning agents. These parameters play a crucial role in the selection of polymers for the area of use of the interlining.

Thus, for example, for the area of shirt interlinings, which must withstand washing conditions of up to 95° C., high-density polyethylene (HDPE) is typically used as hot-seal adhesive. This polymer has a melting range of approximately 130° C., for example, and a low melt flow index (MFI) of 10-20 g/10 minutes (190° C./2.16 kg load). A disadvantage is that fusion temperatures greater than 140° C. are necessary due to the high melting range and high viscosity (corresponding to a low MFI value). In addition, a very large quantity of HDPE is necessary to achieve a sufficient adhesive effect.

In particular for use in applications requiring high resistance to washing and drying conditions, the hot-melt adhesive polymers that are currently commercially available do not have adequate suitability.

Copolyamides, copolyesters, or low-density polyethylene (LDPE) in the melting range of 100-125° C. and having MFI values of 2-70 g/10 minutes (140° C./2.16 kg load) do not result in acceptable separating force values after multiple care treatments.

Furthermore, although HDPE in the melting range of approximately 130° C. and a low MFI value of 2-20 g/10 minutes (190° C./2.16 kg load) results in satisfactory separating force values when used with large quantities of support materials, bubble formation and delamination of the adhesively bonded layers occur during drying processes, for example in the tunnel finisher. The high mechanical strain resulting from the high volumes of hot air and, the addition of steam are extremely stressful for the applied coating of hot-melt adhesive.

Proceeding from this prior art, the object of the present invention is to provide textile fabrics prepared with contact adhesives which may be easily processed using customary fusing presses and which exhibit very good washing resistance up to 95° C. and withstand the extreme drying conditions at high cycle counts.

The object of the present invention consists in providing textile fabrics which are prepared with hot-seal adhesives and which do not have the disadvantages known from the prior art for processing under conditions of standardized tests for severe washing stress followed by high-temperature drying conditions, withstand at least 50 cleaning cycles, and do not have the known disadvantages such as "color pick-up" and loss of adhesion.

The present invention relates to a textile fabric having a coating composed of two layers of thermoplastic hot-seal adhesives of differing compositions applied one on top of the other, the second hot-seal adhesive, which is applied to the first hot-seal adhesive, having a melting point of >135° C. and a melt flow index (MFI) value of 50 to 250 g/10 minutes (190° C./2.16 kg).

The textile fabric is advantageously provided with a coating composed of hot-seal adhesive in which the hot-seal adhesive used for forming the second layer has a melting point of >145° C. and an MFI value of 50 to 200 g/10 minutes (190° C./2.16 kg).

Particularly preferred is a textile fabric in which the hot-seal adhesive used for forming the second layer has a melting point of >150° C. and an MFI value of 50 to 150 g/10 minutes (190° C./2.16 kg).

Further preferred is a textile fabric having a coating composed of hot-seal adhesive in which the second hot-seal adhesive is based on polyolefin, polyurethane, polyester, or polyamide.

Also advantageous is a textile fabric in which the second hot-seal adhesive is based on a polyurethane.

The textile fabric is preferably one in which the second hot-seal adhesive is based on polypropylene containing in a 2-98% by weight ratio a copolyester having a melting point of >145° C. and an MFI of >60 g/10 minutes (190° C./2.16 kg).

Particularly preferred is a textile fabric in which the second hot-seal adhesive is based on polypropylene containing in a 2-98% by weight ratio a copolyester having a melting point of >160° C. and an MFI of >140 g/10 minutes (190° C./2.16 kg).

Furthermore, the textile fabric is preferably one in which the first hot-seal adhesive is based on a crosslinking or thermoplastic polymer.

Particularly preferred is a textile fabric in which the first hot-seal adhesive has an MFI of >10 g/10 minutes (190° C./2.16 kg).

Also preferred is a textile fabric in which the first hot-seal adhesive has an MFI in the range of >20 g/10 minutes (190° C./2.16 kg) to 200 g/10 minutes (190° C./2.16 kg).

The textile fabric is advantageously one in which the first hot-seal adhesive is based on a polyolefin, polyamide, and/or polyester.

One particularly preferred textile fabric is one in which the first hot-seal adhesive is based on a polypropylene.

The textile fabric is preferably one in which the mass ratio of the first and second hot-seal adhesives is 2:1 to 1:3.

Copolyesters and copolyamides having melting points of >145° C. and an MFI of >60 g/q0 minutes (190° C./2.16 kg) may also be used for the second layer.

Surprisingly, it has been found that, by use of contact adhesives having selected melt viscosities and in combination with the double dot process known as such for applying the hot-seal adhesive, interlining having a polyolefin-based hot-seal adhesive may be produced which has good fusion characteristics on outer shell materials at temperatures above 155° C., and which afterwards passes the ISO 15797:2004 test conditions, "Industrial washing and finishing procedures for testing of workwear," for at least 25 cycles beyond 50 cycles, and/or withstands washing conditions up to 95° C., and which exhibits no "color pick-up."

It has also surprisingly been found that, despite comparatively high MFI values for the polymers used, no penetration of the hot-seal adhesive through the outer shell material, or back-tacking for sandwich fusion between the layers, could be determined.

Furthermore, it has surprisingly been found that, in a single-layer application using dispersion paste dot printing or by applying the polymer powder using gravure rollers (powder dot process), the above-described polymers are able to achieve very good test values and higher cycle counts than for standard polymers.

The textile fabrics modified using contact adhesives may be produced by any surface-forming technique. Examples include weaving, layering, knitting, stitch bonding, or wet or dry nonwoven manufacturing processes.

Within the context of this description, the term "textile fabric" is understood to mean woven fabric, warp- or weft-knitted fabric, non-crimp fabric, or in particular nonwoven fabric.

The textile fabrics according to the invention, in particular the nonwoven fabrics, typically have a weight per unit area of 10 to 500 g/m$^2$.

Use of textile fabrics having a weight per unit area of 30 to 200 g/m$^2$ is particularly preferred.

Textile fabrics according to the invention may be bonded in a manner known as such, for example by means of mechanical or hydrodynamic needles, fusion of binder fibers present in the textile fabric, thermal-mechanical bonding, or application of binders.

After the textile fabric is manufactured it is preferably provided, in a manner known as such, with two layers of different hot-seal adhesives according to the double dot process.

Polyolefin-based adhesives having melting indices (MFI values) in the ranges defined above are preferably used as hot-seal adhesives.

Within the context of this description, "melting index" is understood to mean the MFI value determined according to DIN 53735:1980-10 or ISO 1133.

Besides homopolymers derived from alpha olefins, preferably propylene or ethylene, the term "polyolefin" also encompasses copolymers which, in addition to structural units derived from an alpha olefin, also include structural units derived from other ethylenically unsaturated hydrocarbons, for example other alpha olefins and/or vinyl aromatics such as styrene.

Examples of alpha olefins include ethylene, 1-propene, 1-butene, 1-pentene, 1-hexene, 1-octene, or 1-decene.

Any type of polyolefin known as such may be used. Examples include polyolefins prepared by the Ziegler-Natta process or by use of metallocene catalysts.

Examples of polyolefins preferably used include polyethylenes, polypropylenes, or copolymers derived from ethylene and propylene. Further examples include copolymers derived from ethylene or propylene with other alpha olefins of higher carbon number, such as 1-butene, 1-pentene, 1-hexene, 1-octene, or 1-decene One or both layers of the hot-seal adhesive may contain a modified polyolefin in addition to the particular polyolefin (mixture). A copolymer is understood as one which is derived from at least one alpha olefin and an ethylenically unsaturated acid or its anhydride, or an ethylenically unsaturated epoxy compound, or a mixture of two or more of these comonomers. The modification may be carried out in any desired manner, for example as the copolymerization of alpha olefin monomer(s) together with selected comonomer(s), and/or as grafting of selected polar comonomer(s) to a polyolefin.

Examples of alpha olefins or other olefinically unsaturated hydrocarbons which have been used for preparing this group of copolymers, individually or in combination with one another, have been listed above in the description of the preparation of homo- or copolymers derived from one or more alpha olefins.

Preferably used in the group of modified polyolefins are polypropylenes or in particular polyethylenes, or copolymers derived from ethylene and acrylic and/or methacrylic esters, in particular the alkyl esters.

The hot-seal adhesives used according to the invention may also contain other auxiliary materials known as such. These auxiliary materials are added depending on the desired property profile and the method of application and processing of the hot-seal adhesive. Examples of such additives include emulsifiers, thickeners, pigments, and auxiliary processing agents.

The material properties of the lower layer directly applied to the coated textile fabric are advantageously selected in such a way that they have a lower thermoplastic flow than the overlying upper layer under the conditions of hot-seal adhesion. According to the invention, this may achieved by using hot-seal adhesives having the stated melt index ranges corresponding to the melt viscosity of the hot-seal coating.

The hot-seal adhesives are applied to the surface of the textile fabric in the form of a uniform or preferably irregular pattern. The coating grid may have a linear, gridded, or spiral shape, or may be implemented in any other uniform or irregular grid pattern. The hot-seal adhesives are preferably applied in the form of dot matrices which are preferably irregular.

In one preferred embodiment, the lower layer situated directly on the fabric contains 90 to 100% by weight polypropylene and 0 to 10% by weight of a high-density polyethylene (HDPE), and the upper layer situated on the lower layer contains a polypropylene having a melt flow that is equal to or greater than that of the polymer used in the lower layer.

In a further preferred embodiment, the lower layer applied to the fabric is composed of a paste which has been applied to the fabric in the form of an irregular dot matrix, and the overlying top layer is composed of a powder or powder mixture which has been applied to the fabric. The powder (mixture) adheres at locations where the paste is present, whereas at the other locations it is easily removed from the surface of the fabric.

The mass ratio of the first and second hot-seal adhesives used according to the invention may fluctuate over wide ranges, and is typically in a range of 5:1 to 1:5, preferably in a range of 2:1 to 1:3.

The invention further relates to a method for producing the above-described textile fabric. The method comprises the following steps:

a) Producing a textile fabric using a textile fabric manufacturing technique in a manner known as such, b) Applying a layer of a first hot-seal adhesive to the textile fabric in the form of a uniform or irregular pattern in a manner known as such, and c) Applying a layer of a second hot-seal adhesive to the textile fabric to form a layer of the second hot-seal adhesive over the layer of first hot-seal adhesive in a manner known as such.

The first and second hot-seal adhesives are used according to the above definitions.

The method is a modified double dot process characterized by the use of selected hot-seal adhesives.

The hot-seal adhesives according to the invention may be produced in various ways.

Examples include grinding the components to a powder mixture, mixing the components in granulated form, followed by grinding, and mixing the components by means of extrusion, followed by grinding.

The hot-seal adhesives may also be applied using various processes known as such.

Thus, in a first step a paste of the first hot-seal adhesive may be applied to the textile fabric in a uniform or preferably irregular pattern. The application may be performed by screen printing or by use of a structured roller. In a second step a powder composed of the second hot-seal adhesive may then be dispersed over the textile fabric so that it remains adherent to the paste at the locations of the first hot-seal adhesive. The powder may be removed from the remaining locations on the surface of the textile fabric by suction. In subsequent thermal treatment the first and second hot-seal adhesives are fused as overlying layers.

The textile fabrics modified according to the invention may be used as interlining or lining materials. The invention further relates to use for these purposes, in particular as bonding interlining and/or as lining which can withstand stress during care treatment.

The textile fabrics according to the invention are particularly suited for use as bonding interlining or reinforcement interlining for collars and cuffs for workwear.

The textile fabrics modified according to the invention may be adhesively bonded, in a manner known as such, to a textile outer shell to be reinforced.

The following examples explain the invention without limiting the invention thereto.

EXAMPLE 1

100% polyester ("PES") based on a nonwoven fabric and having a weight per unit area of 100 g/m$^2$ was coated using the double dot process, which is known as such. For the lower dot a paste was used, to which customary auxiliary materials such as emulsifiers, thickeners, and auxiliary processing agents were added. This paste contained as polymer component an HDPE having a melting point of 130° C. and an MFI value of 10 (g/10 min at 190° C. under a load of 2.16 kg), and as a dusting powder for the upper dot a polyurethane powder was applied having a melting range of 145-155° C. and an MFI value of greater than 200 (g/10 min at 190° C./load of 2.16 kg).

In the coating process, 12 g of lower dot paste was applied and coated with 25 g of dusting powder.

The interlining thus produced was fusible at temperatures of 175° C. with very good adhesion to various upper materials, and withstood a 95° C. wash.

The separating forces achieved after fusion (175° C./20 s/2 bar—Gygli shirt press) were 21.6 N/5 cm, and after 10×95° C. washes and drying were 17.4 N/5 cm.

After the fusion with a 30 s fusion time, the separating forces were 30.7 N/5 cm, and after 10×95° C. washes and drying were 17.4 N/5 cm.

This interlining, fused as above for 25 s at the same press setting, withstood 28 cycles in an industrial washer, in each case without bubbles in subsequent drying in a tunnel finisher.

EXAMPLE 2

A woven fabric of 100% cotton, pretreated and prepared for use as shirt interlining and having a weight per unit area of 130 g/m$^2$, was coated using the double dot process. For the lower dot a paste was used, to which customary auxiliary materials such as emulsifiers, thickeners, and auxiliary processing agents were added. The paste contained as polymer component a polypropylene having a melting point of 160° C. and an MFI value of 50 (g/10 min at 190° C. and 2.16 kg load). As a dusting powder for the upper dot a polypropylene was applied having a melting point of 160° C. and an MFI value of greater than 150 (g/10 min at 190° C. and 2.16 kg load). In the coating process, 10 g of lower dot paste was applied and coated with 19 g of dusting powder.

The interlining thus produced was fusible at temperatures of 180° C. with very good adhesion to various upper materials, and withstood a 95° C. wash.

The separating forces achieved after fusion (180° C./20 s/2 bar —Gygli shirt press) were 23.5 N/5 cm, and after 10×95° C. washes and drying were 21.2 N/5 cm. After the fusion with a 30 s fusion time, the separating forces were 25.7 N/5 cm, and after 10×95° C. washes and drying were 22.4 N/5 cm. This interlining, fused as above for 25 s at the same press setting, withstood more than 50 cycles in an industrial washer, in each case without bubbles in subsequent drying in a tunnel finisher.

What is claimed is:

1. A textile fabric, comprising:

a bonded, nonwoven textile fabric substrate having a basis weight in the range of 30 to 200 g/m$^2$;

a first layer of dots including a crosslinked hot-seal adhesive applied to the textile fabric substrate, the first layer having a first side proximate to said textile fabric substrate and a second side distal to said textile fabric substrate, a second layer of dots including a thermoplastic hot-seal adhesive applied to the second side of said first layer, wherein:

the first and second layers differ in composition and said dots are in matrices that are an irregular pattern, the second layer has a melting point of >135° C. and a melt flow index (MFI) value of 50 to 250 g/10 minutes (190° C./2.16 kg) and is based on at least one polyolefin, polyester, polyamide, and combinations thereof.

2. The textile fabric according to claim 1, wherein the second layer has a melting point of >145° C. and an MFI value of 50 to 200 g/10 minutes (190° C./2.16 kg).

3. The textile fabric according to claim 1, wherein the second layer has a melting point of >150° C. and an MFI value of 50 to 150 g/10 minutes (190° C./2.16 kg).

4. The textile fabric according to claim 1, wherein the second layer is based on a polypropylene containing in a 2-98% by weight ratio blend of a copolyester having a melting point of >145° C. and an MFI of >60 g/10 minutes (190° C./2.16 kg).

5. The textile fabric according to claim 4, the second layer is a polypropylene containing in a 2-98% by weight ratio blend of a copolyester having a melting point of >160° C. and an MFI of >140 g/10 minutes (190° C./2.16 kg).

6. The textile fabric according to claim 1, first layer has an MFI of >10 g/10 minutes (190° C./2.16 kg).

7. The textile fabric according to claim 1, the first layer has an MFI in the range of >20 g/10 minutes (190° C./2.16 kg) to 200 g/10 minutes (190° C./2.16 kg).

8. The textile fabric according to claim 1, the first layer is based on at least one polyolefin, polyamide, polyester, and combinations thereof.

9. The textile fabric according to claim 8, the first layer is based on a polypropylene.

10. The textile fabric according to claim 1, wherein a mass ratio of the first layer to the second layer ranges from 2:1to 1:3.

11. The textile fabric according to claim 1 positioned as interlining and/or as lining which can withstand stress during care treatment.

12. The textile fabric according to claim 10 positioned as a bonding interlining or reinforcement interlining for collars and cuffs for workwear.

13. The method for producing a textile fabric comprising the following steps:

producing a bonded, nonwoven textile fabric having a basis weight in the range of 30 to 200 g/m$^2$ using a textile fabric manufacturing technique;

applying a first layer of dots including a first crosslinked hot-seal adhesive to the textile fabric the first layer having a first side proximate to said textile fabric substrate and a second side distal to said textile fabric substrate; and applying a second layer of dots including a second thermoplastic hot-seal adhesive to the textile fabric so as to form the layer of the second hot-seal adhesive over the layer of a first hot-seal adhesive, the first and second hot-seal adhesives of differing compositions and said dots are in matrices that are an irregular pattern and the second hot-seal adhesive, which is applied to the first hot-seal adhesive, having a melting point of >135° C. and a melt flow index (MFI) value of 50 to 250 g/10 minutes (190° C./2.16 kg) and is based on at least one polyolefin, polyester, polyamide and combinations thereof.

* * * * *